GOLF PRACTICE DEVICE

BACKGROUND AND SUMMARY OF THE INVENTION

The present invention relates to an improved golf practice device, and more particularly, to an improved device for permitting golfers to practice their golf swings in relatively restricted or confined areas.

The game of golf is a popular sport, and in recent years, more and more people have been playing the game. In order to play golf proficiently, a golfer must develop and maintain a proper swing. One of the problems with playing golf is that normally a golfer has had to go to a golf course or driving range in order to practice his swing. However, a trip to a golf course or a driving range is relatively expensive and often may be quite time consuming. Consequently, there has long been a need for an inexpensive, relatively simple device which would permit a golfer to realistically practice his swing in a relatively restricted or confined area, such as in his yard or the like.

In the past, a variety of different devices have been proposed for the purpose of enabling a golfer to practice his swing in a relatively restricted or confined area. Several such devices are disclosed in U.S. Letters Pat. Nos. D165,196; 88,660; 1,259,933; 1,732,971; 1,857,588; 1,932,049; 1,199,518; 2,832,038; 2,961,241; 3,348,416; 3,444,741; 3,472,075; 3,656,759; 3,830,504; and in Japanese patent No. 892,665.

It is a primary object of my present invention to provide an improved golf practice device which provides realistic practice for a golfer's golf swing for both tee and fairway shots, which may be readily used by both right and left handed golfers, which may be used in a relatively restricted or confined area, and which may be relatively inexpensively manufactured so as to permit the successful commercialization thereof. More specifically, my improved golf practice device includes a molded plastic circular base having an integral, upright center post formed thereon. A unique center pin, driven in the ground, has its upper end disposed within a cavity formed within the center post to assist in securing the improved golf practice device to the ground. A plurality of unique pegs extend through a plurality of apertures evenly spaced about the periphery of the base to also secure the device to the ground.

A curved molded plastic arm is mounted, at one end, on the center post of the base so that the arm may rotate about the longitudinal axis of the center post in a horizontal plane spaced above the plane of the base. A cup member is formed at the other end of the arm and a golf-ball-like ball is nested and secured in the cup member so that a substantial portion of the ball is visible to the golfer using my improved golf practice device and so that the ball may be struck by a golfer properly swinging his golf club. When the ball is struck by a club, the ball, and thus the arm, rotates about the longitudinal axis of the center post. The arm is curved, as noted above, and extends beyond the periphery of the base, so that when the golfer addresses the ball, it appears to the golfer as if he were hitting the ball on the golf course or driving range.

The arm may be mounted on the center post so as to permit right handed golfers to use my improved device, i.e. with the ball facing in a counterclockwise direction, when the device is viewed from above. If my golf practice device is then to be used by a left handed golfer, the arm is removed from the center post, rotated 180° about its longitudinal axis and then remounted on the center post so that the ball is facing in a clockwise direction when the device is viewed from above. A spacer ring is also adapted to be mounted on the center post and permits the height of the arm, as measured from the ground, to be adjusted between two positions, one position simulating fairway shots while the other position simulating tee shots.

One of the principal advantages of my improved golf practice device, from the standpoint of its commercialization, is that substantially all of the components of the device may be made from molded plastic. This substantially reduces the manufacturing cost of the device without any appreciable decrease in strength. In addition, the components may be manufactured so as to have an aesthetically pleasing appearance and this, of course, is also an extremely important consideration in connection with the successful marketing of today's leisure time products.

These and other objects and advantages of my present invention will become apparent from the following description of the preferred embodiment of my invention, described in connection with the accompanying drawings.

Figure 1:
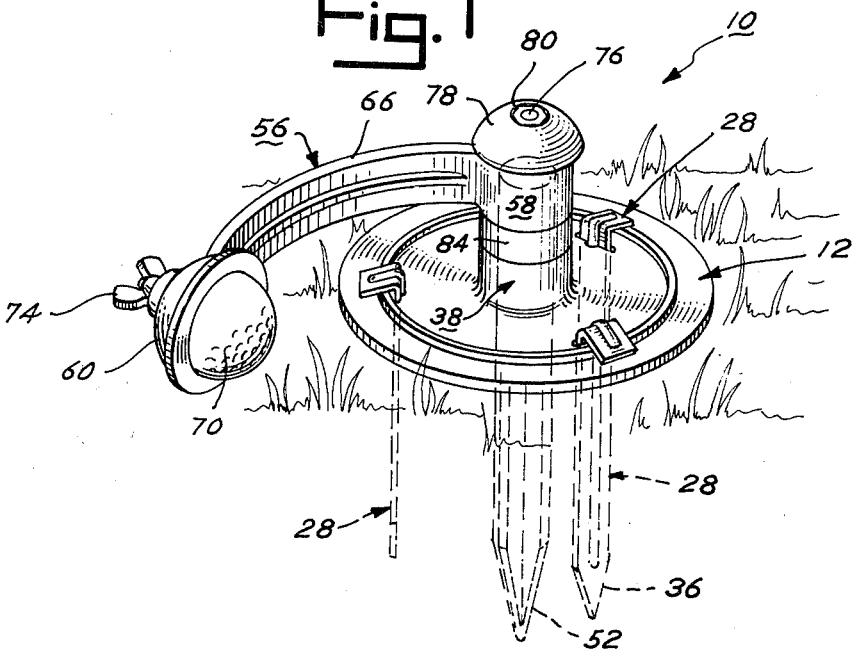
FIG. 1 is a perspective view of an improved golf practice device of the present invention shown secured to the ground.

Throughout the various figures of the drawings, the same reference numerals will be used to designate the same parts or components. Moreover, when the terms "right," "left," "right end," "left end," "lower" and "upper" are used herein, it is to be understood that these terms have reference to the structure shown in the drawings as it would appear to a person viewing the drawings.

DESCRIPTION OF THE PREFERRED EMBODIMENT

Referring now to the FIGS. 1–6, an improved golf practice device embodying the principles of my present invention is shown generally at 10 and as noted above, is adapted to be utilized by golfers to practice their swings in relatively restricted or confined areas such as their back yards, in parks or even in recreation rooms. The golf practice device 10 includes a molded plastic, relatively thin, circular base 12 having generally flat parallel upper and lower surfaces 14 and 16. The upper surface 14 of the base 12 includes a generally circular ridge 18 spaced radially inwardly from the peripheral edge 20 of the base. The lower surface 16 is unobstructed and is adapted to be disposed, horizontally, in molding process, a threaded bolt 76 is pressed into the closed end 44 so that it becomes encased within the upper, closed end 44 of the second cylindrical portion 42, with the upper threaded end of the bolt 76 projecting upwardly beyond the closed end 44 and with the longitudinal axis of the bolt 76 being coaxial with the central longitudinal axis of the center post 38.

A cap 78 is molded from plastic material with a metal nut 80 pressed therein. The nut 80 is positioned, with respect to the cap 78, so that its central axis and the central axis of the cap are coaxial and so that access can be had to the nut 80 from above and below the cap 78. The size of the nut 80 is selected so that the nut, and thus the cap 78, can be screwed on the projecting upper end of the threaded bolt 76. The cap 78 is molded so that its lower or under surface 82 is disposed in a horizontal plane when the cap 78 is threaded onto the bolt 76.

A molded plastic spacer ring 84 is mounted on the second cylindrical portion 42 of the center post 38. The spacer ring 84 has an inner diameter substantially equal to the outer diameter of the second cylindrical portion 42 and an outer diameter substantially equal to the outer diameter of the first cylindrical portion 40. The height of the spacer ring 84 is selected so that combined heights of the ring 84 and the collar 58 equal the height or length of the second cylindrical portion 42 as measured from the shoulder 46 to the closed end 44 of the central post 38. Thus, when the spacer ring 84 and the collar 58 of the arm 56 are both mounted on the second cylindrical portion 42, and the cap 78 is screwed onto the threaded bolt 76, the lower surface 82 of the cap 78 may engage the ring 84 and the collar 58 and securely hold or clamp them on the center post 38. The spacer ring 84 may be disposed on the center post either below the collar 58, i.e. between the shoulder 46 and the collar 58, or above the collar 58, i.e. between the collar 58 and the cap 78. The height of the arm 56, and thus the ball 70, above the ground can be adjusted by disposing the spacer ring 84 either above or below the collar 58. The dimensions of the center post 38, the collar 58 and the spacer ring 84 are selected so that when the ring 84 is disposed above the collar 58, the ball 70 is positioned at a height above the ground that simulates the height of a golf ball on a fairway. Thus, when the ball 70 is in this position, the golfer can practice his fairway shots. Similarly, when the spacer ring 84 is disposed or positioned below the collar 58, the ball 70 is positioned above the ground at a height that simulates the height of a golf ball on a golf tee. Thus, when the ball 70 is in this position, a golfer can practice his tee shots.

Figure 2:
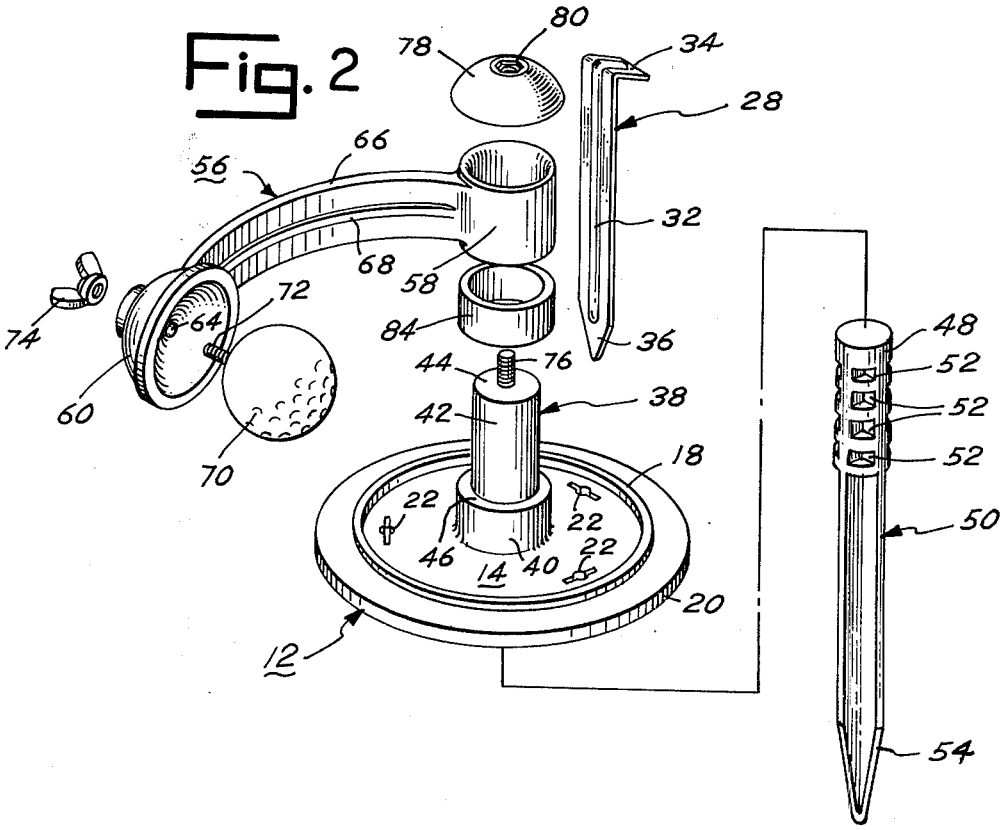
FIG. 2 is an exploded, perspective view of the improved golf practice device shown in FIG. 1.
Figure 3:
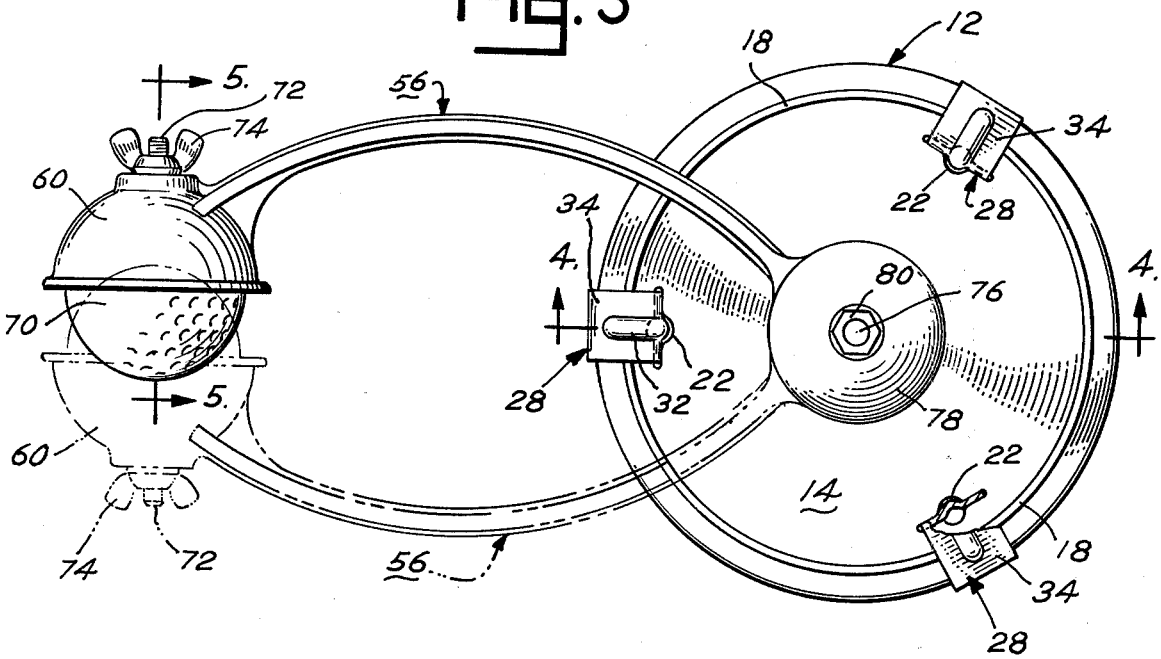
FIG. 3 is a top plan view of the improved golf practice device shown in FIG. 1, with the arm being shown for use by right handed golfers, (shown by full line section) and for use by left handed golfers (shown by phantom line section).
Figure 5:
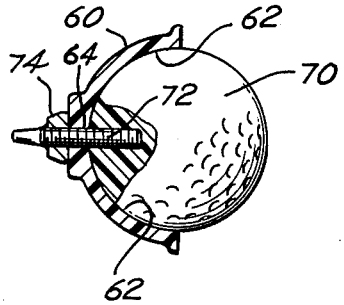
FIG. 5 is a partial, cross-sectional view taken along the line 5—5 in FIG. 3.
Figure 6:
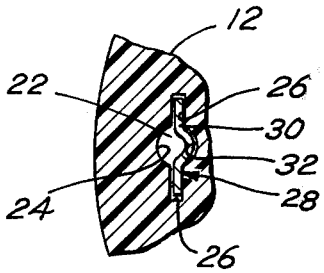
FIG. 6 is a partial, cross-sectional view taken along the line 6—6 in FIG. 4.
Figure 4:
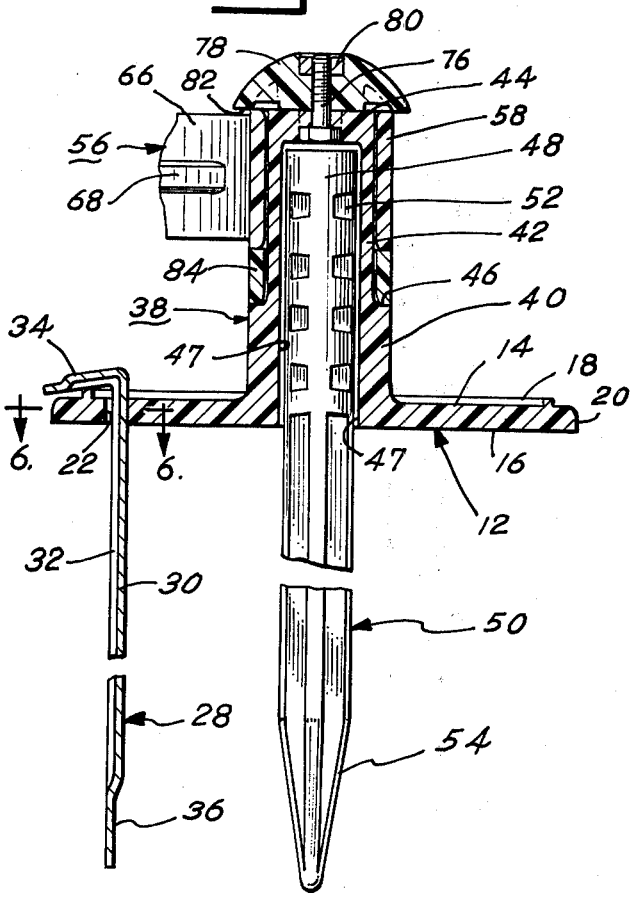
FIG. 4 is a vertical, cross-sectional view taken along the line 4—4 in FIG. 3.

In addition, the structure of the arm 56 and the center post 38 permits my improved golf practice device 10 to be utilized by both left and right handed golfers. In this regard, the device 10, as shown in FIGS. 1, 2 and 3, is positioned so as to permit a right handed golfer to hit the ball 70. To adapt the device 10, as shown in FIG. 1, so that a left handed golfer may use it, it is simply necessary to unscrew the cap 78 and lift the arm 56 off of the center post 38 so that the collar 58 is no longer positioned around the post 38. The arm 56 is then rotated through an arc of 180° about its longitudinal axis, and the collar 58 is again positioned about the center post 38 with the arm 56 then being positioned as shown in phantom section lines in FIG. 3. Thereafter, the cap 78 is again screwed onto the threaded bolt 76, and the device 10 is ready for use by a left handed golfer.

As best shown in FIG. 3, the length of the arm 56 is such that the ball 70 is positioned well beyond the peripheral edge 20 of the base 12 so that it is highly unlikely that a golf club being swung at the ball 70 will strike the base 12 or the center post 38. The arm 56 is curved away from the exposed face of the ball 70 so that it is unlikely that the golf club will strike the intermediate portion 66 of the arm 56 even if the ball is entirely missed by the golf club. As noted above, the arm 56, and more particularly the intermediate portion 66 thereof, is constructed so that the arm may flex. Thus, after the ball 70 is struck by the golf club, the arm 56 will bend. This bending, together with the rotation of the arm 56 about the vertical longitudinal axis of the center post 38, will dissipate the energy transferred to the ball 70 by the blow of the golf club.

My improved golf practice device 10 may be easily and readily mounted in the ground or other similar surface. Initially, the center pin 50 is driven in the ground so that the upper portion 48 thereof projects above the ground. The base 12 is then set over the upper portion 48 of the center pin 50 so that the upper portion 48 is disposed within the cavity 47. Thereafter, lower ends 36 of the pegs 28 are introduced into the apertures 22, and the pegs are driven into the ground until the upper ends 34 of the pegs abut the upper surface 14 of the base. Of course, if the device 10 is to be mounted on some surface other than the ground, the pegs 28 and center pin 50 may be replaced with other suitable securing means.

The collar 58 of the arm 56 and the spacer ring 84 are then mounted on the center post 38. The cap 78 is screwed on the threaded bolt 76 until the cap 78, or more particularly its lower surface 82 abuts and clamps the ring 84 and collar 58. As a safety measure, the golfer should be sure that some soft or spongy material, such as turf or rubber matting, is disposed under the ball 70.

If, for some reason, the ball 70 becomes damaged, the ball can be easily removed from the cup 60 by unscrewing the wing nut 74 from the projecting end of the stud 72 and simply removing the ball from the cup 60. Another replacement ball 70 can then be secured to the device 10 by simple expedient of introducing the other ball 70 into the cup 60 so that the stud 72, screwed into the ball, extends through the aperture 64. The wing nut 74 is then used to secure the ball 70 to the handle 56.

As noted above, all of the components of the improved golf practice device 10, except the pegs 28, the stud 72, the bolt 76 and the nut 80 can be made from plastic material of the type which can be readily molded. One such plastic material is polyethylene.

From the foregoing it should be apparent to those having skill in this art that my improved golf practice device affords a novel means by which a golfer may practice both tee and fairway shots. The improved device 10 may be relatively inexpensively manufactured because substantially all of its component parts can be of molded plastic construction. Not only does the use of such molded plastic components decrease the manufacturing costs, but also greatly enhances the appearance of the device, thereby giving the device widespread customer appeal.

It should also be obvious to persons having skill in this art that modifications or changes could be made in the structure or design of my improved golf practice device 10 described hereinabove. In other words, the improved golf practice device 10 disclosed herein may be embodied in other specific forms without departing from the spirit or central characteristics of my invention. Thus the preferred embodiment of my improved golf practice device 10 described herein is therefore to be considered in all respects as illustrative and not restrictive, the scope of my invention being indicated by the appended claims, rather than by the foregoing description, and all changes which come within the meaning and range of equivalency of the claims are therefore intended to be embraced herein.

I claim:

1. An improved device for permitting right handed and left handed golfers to practice their golf swings in a relatively restricted or confined area, comprising:

a molded plastic body including a flat, generally circular base which has an upper surface and a lower surface that is adapted to be in contact with the ground or the like; the body also including a center post which projects upwardly from the upper surface of the base and which is disposed so that its central longitudinal axis is substantially coaxial with the center of the base and is substantially perpendicular to the plane of the lower surface of the base; the base having a plurality of evenly spaced apertures disposed about its periphery, each of these apertures being adapted to receive a peg which is to be driven into the ground or the like and which is utilized to secure the body to the ground or the like; the center post comprising a first cylindrical portion and a second smaller diameter, cylindrical portion, with the first cylindrical portion being adjacent to the upper surface of the base, with a shoulder being formed at the juncture of the first and second cylindrical portions; and with the upper end of the second cylindrical portion terminating at an upper closed end; the center post also having an internal recess formed therein which extends from the lower surface of the base upwardly into the center post and which is open, adjacent to the lower surface of the base so as to permit access to the recess from without the body and so as to receive the upper end of a center pin which is to be driven into the ground or the like and which is utilized to restrain the body from movement with respect to the ground; a bolt having a threaded shank and being pressed into the upper, closed end of the second cylindrical portion of the center post so that the longitudinal axis of the threaded shank of the bolt is substantially coaxial with the central longitudinal axis of the center post and so that the threaded shank of the bolt projects upwardly beyond the upper closed end of the second cylindrical portion of the center post; an elongated, curved, molded plastic arm having a cylindrical, vertically disposed collar formed at one end thereof and having a horizontally facing cup formed at its other end, the collar being disposed about the second portion of the center post so that the central longitudinal axis of the collar is coaxial with the central longitudinal axis of the center post and so that the arm may be rotated in a horizontal plane about the central longitudinal axis of the center post and spaced a preselected distance above the upper surface of the base, the cup having a substantially hemispherical shaped, inner concave surface and having a centrally disposed aperture formed therethrough, the length of the arm, from the collar to the cup, being greater than the radius of the base so that the cup is positioned beyond the periphery of the base; a ball-like member having the appearance of a golf ball and being disposed in the cup so that at least a portion of the ball-like member is positioned without the cup and is visible to the golfer using the practice device; a double threaded ended stud, one end of which is screwed into the ball-like member and the other end projecting through the aperture in the cup; wing nut means for engaging the other threaded end of the stud for preventing the removal of the ball-like member from the cup; spacer ring means, mounted on the second cylindrical portion of the center post, for adjusting the height of the arm above the upper surface of the base between a first lower position and a second upper position; and a molded plastic cap, including a lower surface and having a horizontally disposed nut enclosed therein, the nut being threadedly engageable with the threaded bolt mounted in the upper end of the second portion of the center post, and the cap, when the nut threadedly engaged the threaded bolt, preventing the collar and spacer ring means from being removed from the center post.

2. The improved device described in claim 1 wherein the spacer ring means is a cylindrical sleeve that is disposed about the second cylindrical portion of the center post, with the sleeve being disposed between the shoulder and the collar when the arm is in its second upper position and with the sleeve being disposed between the collar of the arm and the cap when the arm is in its first lower position; and wherein the lower surface of the cap abuts against the adjacent portion of the collar or the sleeve, as the case may be, when the cap is threaded into the threaded bolt.

3. The improved device described in claim 1 wherein upon removal of the cap from the threaded bolt, the arm may be removed from the center post, turned through an arc of 180° about its longitudinal axis, and remounted on the center post so that the golf practice device may be utilized by both left handed and right handed golfers.

4. The improved device described in claim 1 wherein each of the evenly spaced apertures formed about the periphery of the base includes a circular central portion and diametrically opposed extended portions; and wherein the pegs each include a flat body portion having a centrally disposed longitudinally extending, strengthening groove formed therein.

5. The improved device described in claim 1 wherein the center pin is a molded plastic member whose upper end has a generally cylindrical configuration, with vertically disposed levels of regularly spaced cut-away segments formed about its peripheral surface, and whose lower end has a generally "cross" or X-shaped cross-section.

* * * * *

United States Patent [19]

Myer

[11] 3,981,509

[45] Sept. 21, 1976

[54] LATCHING MEANS FOR RELEASABLY SUPPORTING A DRIVEN ROTATABLE MEMBER

[75] Inventor: William R. Myer, Frenchtown, N.J.

[73] Assignee: Geometric Machine and Design Corporation, Woodbridge, N.J.

[22] Filed: Oct. 31, 1974

[21] Appl. No.: 519,548

[52] U.S. Cl. ..... 279/1 R; 192/114 R; 242/68.4

[51] Int. Cl.[2] ..... B23B 33/00; B23Q 1/08

[58] Field of Search ..... 279/1 R, 1 DC; 242/68, 242/68.4, 58.6; 192/67 R, 114; 64/1

[56] References Cited

UNITED STATES PATENTS

| | | | |
|---|---|---|---|
| 1,803,180 | 4/1931 | Gargolinski | 242/68.4 |
| 2,488,231 | 11/1949 | Pegard | 192/67 R |
| 2,735,684 | 2/1956 | Longee et al. | 192/114 X |
| 2,739,685 | 3/1956 | Paulauich | 192/114 |
| 3,176,928 | 4/1965 | Saunders | 242/58.6 |
| 3,246,858 | 4/1966 | Alexeff | 242/68.4 |
| 3,480,225 | 11/1969 | Alexeff | 242/68.4 |

FOREIGN PATENTS OR APPLICATIONS

| | | | |
|---|---|---|---|
| 237,585 | 7/1969 | U.S.S.R. | 279/1 R |

*Primary Examiner*—J. M. Meister
*Assistant Examiner*—W. R. Briggs
*Attorney, Agent, or Firm*—Daniel H. Bobis

[57] ABSTRACT

Support and Latching Means for one end of a relatively heavy rotatable member having a housing with bearing means in the axial line of said rotatable member for supporting the rotatable member when engaged for rotation, arcuate wall means adjacent and concentric with the bearing means forms a transfer cavity to receive the supported end of the rotatable member in the disengaged position, a pass-thru opening in said bearing means, a transfer opening in said arcuate wall, said pass-thru opening sized less than the diameter of the supported end of the rotatable member and communicating with said transfer opening to permit the supported end of the rotatable member to be moved into and out of said housing and to hold the supported end in assembled position when the rotatable member is engaged for rotation, means operative to impart lateral movement to said rotatable member to move the same in said housing from the disengaged position in the transfer cavity to the engaged position in said bearing means, and a raised surface means adjacent the lowermost point of said transfer opening to prevent the rotatable member from escaping from the transfer cavity when the rotatable member is in the disengaged position.

Additionally, the combination of rotatable member for rewinding slit materials thereon with the support latching means above described on at least one end, and yoke means operatively associated with the support and latching means to permit engagement with the rewinding elements on the rotating member.

Additionally, the combination above described with support and latching means at both ends of the rotatable member, and coacting yoke means at each respective and operative with an associated support and latching means to engage the rewind elements on the rotatable members.

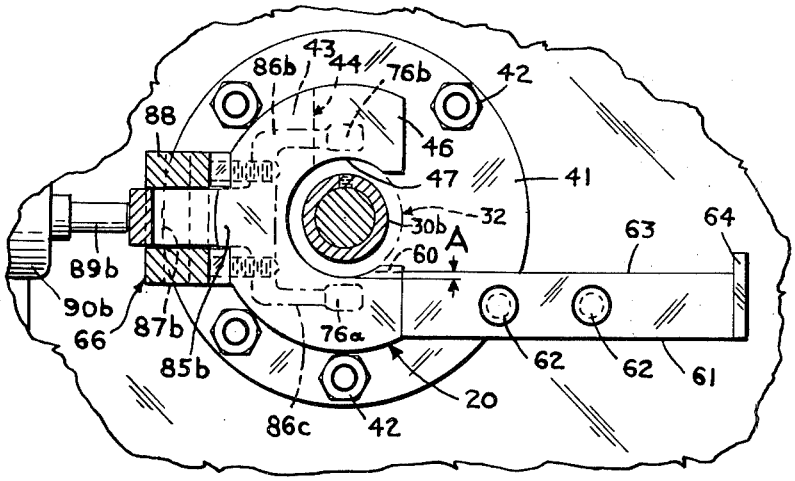

15 Claims, 7 Drawing Figures